US008906201B2

(12) United States Patent
Saastamoinen et al.

(10) Patent No.: US 8,906,201 B2
(45) **Date of Patent: *Dec. 9, 2014**

(54) USE OF ACIDIC WATER IN THE MANUFACTURE OF PAPER

(75) Inventors: Sakari Saastamoinen, Hämeenlinna (FI); Pentti Virtanen, Valkeakoski (FI)

(73) Assignee: Nordkalk Oy Ab, Pargas (FI)

( * ) Notice: Subject to any disclaimer, the term of this patent is extended or adjusted under 35 U.S.C. 154(b) by 0 days.

This patent is subject to a terminal disclaimer.

(21) Appl. No.: 13/642,183

(22) PCT Filed: Apr. 21, 2011

(86) PCT No.: PCT/FI2011/050366

§ 371 (c)(1),
(2), (4) Date: Nov. 21, 2012

(87) PCT Pub. No.: WO2011/131843

PCT Pub. Date: Oct. 27, 2011

(65) Prior Publication Data

US 2013/0062028 A1 Mar. 14, 2013

(30) Foreign Application Priority Data

Apr. 22, 2010 (FI) ..... 20105437

(51) Int. Cl.
*D21H 11/00* (2006.01)

(52) U.S. Cl.
USPC ..... 162/164.6

(58) Field of Classification Search
USPC ..... 162/164.6, 175, 181.2, 164.1, 164.4, 162/168.1, 168.2; 210/198.1, 702, 705
See application file for complete search history.

(56) References Cited

U.S. PATENT DOCUMENTS

| | | | | |
|---|---|---|---|---|
| 5,827,398 | A * | 10/1998 | Depasquale et al. | 162/164.1 |
| 7,056,419 | B2 | 6/2006 | Sundaram et al. | |
| 2005/0257907 | A1 | 11/2005 | Dougherty et al. | |
| 2007/0051480 | A1 | 3/2007 | Doelle | |
| 2007/0151681 | A1 | 7/2007 | Doelle | |
| 2007/0181275 | A1 * | 8/2007 | Ball | 162/181.2 |
| 2008/0210391 | A1 | 9/2008 | Pfalzer et al. | |
| 2011/0000633 | A1 * | 1/2011 | Kukkamaki et al. | 162/181.2 |
| 2011/0233124 | A1 * | 9/2011 | Virtanen | 210/198.1 |
| 2013/0112360 | A1 * | 5/2013 | Virtanen et al. | 162/164.6 |
| 2013/0199745 | A1 * | 8/2013 | Virtanen et al. | 162/162 |

FOREIGN PATENT DOCUMENTS

| | | | |
|---|---|---|---|
| EP | 0 344 984 | A2 | 6/1989 |
| EP | 0791685 | A2 | 8/1997 |
| FI | 20085166 | * | 2/2008 |
| FI | 20085969 | | 4/2010 |
| FI | 20105835 | | 2/2012 |
| WO | 2005100690 | A1 | 10/2005 |
| WO | 2010/043768 | A1 | 4/2010 |

OTHER PUBLICATIONS

PCT Search Report for PCT U.S. Appl. No. PCT/FI2011/050366 dated Aug. 3, 2011.

* cited by examiner

*Primary Examiner* — Mark Halpern
(74) *Attorney, Agent, or Firm* — McCormick, Paulding & Huber LLP

(57) ABSTRACT

The present invention relates to a method of manufacturing paper or cardboard, wherein paper or board pulp is diluted with an aqueous composition, which is formed from colloidal-size particles of carbonate and bicarbonate, and other states of carbonate in an aqueous solution, so that the pH in the aqueous solution remains essentially at a value of 6.0-8.3 during the formation, and water is removed from the pulp by draining, pressing, and drying. The invention also relates to a method of manufacturing the aqueous composition used for this purpose.

15 Claims, No Drawings

USE OF ACIDIC WATER IN THE MANUFACTURE OF PAPER

CROSS REFERENCE TO RELATED APPLICATIONS

This application is entitled to the benefit of and incorporates by reference essential subject matter disclosed in International Patent Application No. PCT/FI2011/050366 filed on Apr. 21, 2011 and Finnish Patent Application No. 20105437 filed Apr. 22, 2010.

TECHNICAL FIELD

The present invention relates to an aqueous composition that is formed of colloidal carbonate particles and bicarbonate, and other states of particularly calcium carbonate, under conditions which are suitable for the manufacture of paper or cardboard products. The invention also relates to paper or cardboard products, in the manufacture of which said aqueous composition is used in the dilution.

BACKGROUND

In papermaking, paper or cardboard products are known to be formed by removing water from solid matter pulp. Measured in amounts, water is clearly the biggest raw-material, which is attempted to remove as quickly as possible from the end product (uncoated or coated paper or cardboard) in the wire, press and dryer sections. In papermaking, so-called high consistency pulp is typically first formed, mainly from fibres, water and inorganic fillers or pigments. Before the pulp is spread out in the head box and dewatering is started in the wire section, the high consistency pulp is diluted (typically to a consistency of 0.2-1.5%) to achieve better quality properties.

Dewatering is one of the most important factors that influence the economy of paper manufacture, and it is attempted to influence it chemically, among others using various flocculants and coagulants. Mechanical means of dewatering include, among others, suction boxes and drainage foils, which are intended to accelerate the dewatering process through the means of pulsating. Retention, which is closely related to dewatering, is used in defining the efficiency, by which, the solid matter can be removed from the papermaking process along with the paper or cardboard. An acceleration of the dewatering process and an increase in the solid matter retention improve the efficiency (of the drainage) of the paper machine. This should not, however, take place at the cost of deteriorating the quality of the cardboard. Formation is the measure of an even distribution of the solid matter. Formation and strength are some of the most important quality properties. A quicker dewatering in the wire section enables, among others, an increase in the velocity of the paper machine or the dilution of the head box and through this, the accomplishment of an improved formation. A more effective dewatering process also translates into a decrease in the need for drying energy in the dryer section.

In the paper or cardboard industry, for example colloidal-size calcium carbonate or calcium oxide or calcium hydroxide is used together with carbon dioxide to improve the properties of the end products, as known.

WO 2005/100690 A1 describes the use of calcium carbonate particles of an ultra fine (colloidal) size as a substitute for colloidal silicon dioxide with at least one natural or synthetic polymer to improve the dewatering of the paper pulp. The average particle size of this colloidal calcium carbonate is less than 200 nanometers.

EP 0344984 A2, describes the use of an aqueous colloidal calcium carbonate to improve the retention, drainage and formation in the manufacture of paper. The average particle size of this colloidal calcium carbonate is 100-300 nanometers. This reference discusses the colloidal calcium carbonate (PCC) that is made at a pH of 9-11 and is used together with cationic starch to improve the filler retention, drainage, and formation. In this manufacture of colloidal calcium carbonate, the anionic aspect is accomplished by an anionic dispersing agent (generally, an anionic, organic polymer), whereby, a hybrid product at an alkaline pH is formed, its surface chemistry essentially differing from the colloidal calcium carbonate in aqueous solution of the invention that contains at least bicarbonate.

US 2005257907 suggests that using calcium carbonate particles with an average particle size of less than 200 nm in finishing the paper surface, in connection with surface sizing or coating, results in a higher stiffness of the paper and less holes on the surface of the paper. The publication does not mention treating the process waters with carbonates in ionic state.

EP 0791685 A2 describes the precipitation of calcium carbonate on the surfaces of fibre and fines by adding carbon dioxide to a mixture of calcium hydroxide and paper furnish. As an end result, calcium carbonate crystals, of an average of 500 nanometers, precipitate on the surfaces of the fibre. When considering the results of table 3 of the publication, it can be observed that no improvement in the strength properties is achieved by the method of the publication. On the other hand, a particle of 0.5 micrometers corresponds to the normal particle size used in paper coating and is at least 3-5 times larger than the size category used in the present invention. The differences between the publication and the present invention include that the present invention does not aim to substitute the fibre with filler, but considerable economic advantages are still achieved.

FI 20085969 suggests that an improvement of dewatering, retention, and formation in the pH range of 6-9 is achieved in papermaking using the aqueous solution of colloidal calcium carbonate, bicarbonate, and other states of carbonate, when a charged polymer is used. According to the method of the publication, burnt lime or calcium hydroxide is first added to the process waters, whereafter the pH is lowered using carbon dioxide to the pH range of 6-9. This order of addition, which becomes evident from both the examples and the claims of the publication, and particularly the fact that the pH is not taken into consideration until after the other components have been added, causes variations in the solution pH during the manufacturing process. One weakness of the publication is that the pH variations are not taken into consideration in connection with the manufacturing stage of the composition, whereby problems with the runnability of the paper or cardboard machine, with precipitation, and variations in the brightness, are more likely. When using mechanical pulps, a weakening of the brightness in the alkaline pH range is also to be expected.

U.S. Pat. No. 7,056,419 describes the use of carbon dioxide in controlling the electrical properties of the paper manufacturing components, in order to decrease the amount of chemical additives used in the manufacture of paper. Carbon dioxide is preferably added to the refuse or calcium carbonate slurry. In the reference, the aim is generally to have a positive effect on the paper manufacturing conditions, so that the use of chemical additives could be decreased and, for example, the generation of unwanted reactions and the accumulation of chemicals in the white water system could be avoided. The method according to the publication is not, however, used in forming the colloidal calcium carbonate that is essential for achieving the advantages presented in the invention.

SUMMARY

The object of the present invention is to solve the problems related to the known solutions, so that the solid matter retention, dewatering, and formation are improved, particularly in the manufacture of paper and cardboard products.

A particular object of the invention is the use of colloidal carbonate particles in the aqueous solutions of paper or cardboard manufacture.

A second particular object of the invention is to develop a manufacturing method for paper or cardboard products, wherein any variations of the pH in the solutions have been rendered as small as possible.

Thus, the present invention relates to an aqueous composition, a paper or cardboard product containing it, as well as a method of manufacturing these.

More precisely, the method of manufacturing the paper or cardboard product of the present invention is such that paper or board pulp is diluted with an aqueous composition, which is formed in an aqueous solution, which is flowing and almost fibreless process water or a mixture of this process water and pure water, from carbonate particles having an average particle size of less than 300 nm, bicarbonate ions, and other states of carbonate in an aqueous solution, so that the pH in the aqueous solution remains at a value of 6.0-8.3 during the formation, and water is removed from the pulp by draining, pressing, and drying.

The method of manufacturing the aqueous composition of the invention, in turn, is such that oxide or hydroxide slurry is added to an aqueous solution being flowing and almost fibreless process water or a mixture of this process water and pure water, in a content that is at least 0.01%, calculated from the weight of the solid matter of the paper or board pulp, and, simultaneously, carbon dioxide is added, so that the pH of the solution remains at a value of 6.0-8.3, whereby the aqueous composition is formed, which contains carbonate particles having an average particle size of less than 300 nm, bicarbonate ions, and other states of carbonate.

DETAILED DESCRIPTION

The present invention is multifunctional and improves various properties: both the quality properties of the paper and cardboard and the economic performance of the manufacturing process. Large pH variations in the manufacture of the invention are avoided in the invention, among others since large pH variations easily result in the generation of precipitates and problems with runnability and they cause a weakening in the brightness of particularly mechanical pulp in the alkaline pH range.

The present invention accelerates dewatering, i.e. drainage, and the attachment of the solid matter together, i.e. retention, in processes where it is important to separate solids from water. It has been demonstrated that the invention also improves the structural strength of the paper or cardboard by increasing the stiffness and thickness (bulk) as well as by improving the strength. The invention further considerably improves the opacity and the setting of printing ink on the surface of the paper or cardboard. The invention simplifies the manufacturing of paper and board by decreasing the amount of required chemicals. By using said aqueous composition, the paper manufacture can be simplified and the costs of investments and chemicals in the manufacturing system can be considerably decreased.

Inorganic, cationic coagulants, such as alum, have conventionally been used to improve dewatering. The retention agents, i.e. polymeric flocculants, that are used in the present invention are, however, considerably more effective than alum or polyaluminium chloride in accelerating the dewatering process. Different synthetic and natural polymers function as retention agents in the invention. Natural polymers are generally called polysaccharides. An example of these is starch, which is the most commonly used natural polymer in the manufacturing of paper and board, if fibres are not taken into consideration. Of synthetic polymers, polyacrylamides can be mentioned. Inorganic, so-called microparticles are preferably used together with these polymeric retention agents to improve the dewatering, retention, and formation, particularly by adding them to the paper or cardboard pulp, preferably simultaneously with the polymer, i.e. after the dilution with the aqueous composition. Of these inorganic microparticles, colloidal silicon dioxide (polysilicic acid, silicon dioxide sol, microgel, etc.) and bentonite are especially well suited for this purpose. Other alternatives include other sols, gels, microgels, silicic acids and polysilicic acids or their mixtures that contain bentonites or silicon dioxides.

The strength of the paper and cardboard mainly develops between the charged groups of the fibre and the fines due to hydrogen bonds. These charged groups contain particularly hydroxyl and carboxyl groups. The strength is measured, for example, as tensile strength, tearing strength, bursting strength, bonding strength, and by so-called Scott bond values. The Scott bond describes perhaps most reliably the strength of paper or cardboard made in a hand sheet mould, because there is no orientation of fibres in the sheet mould. The strength can further be divided into wet strength and dry strength. The intention is to primarily influence the strength in a mechanical manner by grinding the fibres, which is aimed at increasing the fibrillation of the fibres. The strength is dependent on the strength of an individual fibre grade, the strength between the fibres, the number of fibre bonds, and the distribution of fibres and bonds in the finished paper or cardboard. In the present invention, the intention is to influence the dry strength preferably also with chemicals, such as starch and acrylamide. The wet strength, on the other hand, is preferably improved chemically, for example using urea-formaldehyde and melamine-formaldehyde resins.

Paper grades that have high filler contents, such as copying paper and certain magazine papers, would generally need improved stiffness. The efforts to achieve lighter basis weights in the manufacturing of paper and cardboard also emphasize the need for stiffness. Generally, the stiffness of the paper weakens the more filler the paper contains or the more the basis weight is reduced. On the other hand, it is desirable to increase the use of fillers, since they are generally much less expensive than fibre as raw material for paper and cardboard.

The solid matter pertaining to this raw material can contain, for example, the following mineral fillers (or coating pigments): kaoline, titanium dioxide, gypsum, talc, ground calcium carbonate (GCC), precipitated calcium carbonate (PCC), and satin white. In addition to the above, the purpose of these is to influence the optical properties (particularly the brightness and opacity), which are some of the most important quality properties especially of printing papers. Generally, the fillers and coating pigments also weaken the strength and said stiffness of the paper and cardboard.

In the present invention, the fibres can be chemical pulp or mechanical pulp. For example, sulphate and sulphite cellulose fibres, dissolving pulp, nano-cellulose, chemi-mechanical (CTMP), thermo-mechanical (TMP) pressure groundwood (PWG), ground pulp, recycled fibre or the fibres of de-inked paper can be used as solid matter. Typically, sulphate and sulphite celluloses are called chemical pulps, and thermo-mechanical, pressure groundwood, and ground pulp are called mechanical pulps.

Other chemicals may, of course, also be used in the paper manufacturing according to the invention, such as optical brighteners, plastic pigments and colours, aluminium compounds, etc.

As disclosed above, it is possible to use various different chemicals in the present invention to improve the profitability of the paper or board machine or the quality of the manufactured product. The purpose of the different chemicals is to improve either the economic performance of the process or a specific important quality property of the paper and board manufacture. In that case, a situation often arises, where unwanted reactions take place between the various chemicals. Using different chemicals easily results in chemical residues in the white water system, which in the paper and board manufacture can appear as precipitations, sticky substances, and other problems with runnability. There are only a few, if any, chemicals that would provide several improvements both in the manufacturing process and in the quality of the product. The present invention, however, improves various properties, such as the quality properties of the paper and cardboard and the economic performance of the manufacturing process.

In particular, the present invention relates to a method of manufacturing a paper or cardboard product, wherein paper or board pulp is diluted with an aqueous composition, which is formed in a flowing aqueous solution from colloidal-size particles of carbonate and bicarbonate, and other states of carbonate, in the aqueous solution, so that the pH in the aqueous solution remains essentially at a value of 6.0-8.3 during the formation, and water is removed from the pulp by draining, pressing, and drying.

According to a preferred embodiment of the invention, the paper or board pulp is first diluted with the aqueous composition, whereafter one or more charged polymers are added and the components are allowed to react with one another before water is removed from the pulp.

This polymer can be dosed into the paper pulp at different stages, at a stage of the paper or board manufacturing process that follows the dilution with the aqueous composition.

Polymer is dosed into the aqueous composition or, most suitably, into the pulp diluted with the same, preferably in an amount of no more than 10%, most suitably 1-8%, calculated from the weight of the solid matter of the pulp.

In the invention, the "colloidal carbonate particle" refers to the small average particle size of the different states of carbonate (e.g., $CO_3^{2-}$ and $HCO_3^-$), which is less than 300 nm, preferably less than 100 nm. The carbonate is preferably calcium carbonate and it is preferably added in a concentration of at least 0.01%, e.g. 0.01-5%, particularly 0.01-3%, calculated from the weight of the solid matter of the pulp.

The paper or board pulp that is diluted with said aqueous composition preferably functions together with one or more charged polymers. These polymers can be natural polymers or synthetic polymers and they can be dosed into the pulp or stock at different points or several points in the white water system of the paper or board machine. They are particularly used as retention agents.

Together with the aqueous composition, the polymers bring about an improvement in various sectors of the paper or board manufacture, such as the retention. To achieve the best possible effects, however, it is also important that there are ionic states of carbonate (particularly bicarbonate) in the aqueous solution together with the colloidal calcium carbonate.

According to a particularly preferred embodiment of the invention, the charged polymer is a natural polymer, synthetic polymer, copolymer or a mixture of the above; particularly cationic polyacrylamide, polyethyleneimine, starch, polydadmac, polyacrylamide, polyamine, starch-based coagulant, a copolymer of the above or a mixture of two or more such polymers or copolymers. The charged polymer is most suitably polydadmac, polyamine, polyacrylamide or the copolymer of two or more of these.

According to another preferred embodiment of the invention, a compound that contains water-soluble aluminium and among others strengthens the effect of the polymer is also dosed into the aqueous composition or the pulp that is diluted with the same, preferably in an amount of up to 10%, most preferably 1-8%, calculated from the weight of the solid matter of the pulp.

In the present invention, an aqueous composition is thus exploited, which is formed of colloidal carbonate particles, bicarbonate and other states of carbonate at a pH of 6.0-8.3, in a concentration of at least 0.01%, e.g. 0.01-5%, preferably 0.01-3%, calculated from the weight of the solid matter. Such an aqueous composition according to the invention is also called "acidic water".

When this composition is used in the paper or board manufacture, the fibre pulp is partly or fully diluted with this composition.

In the manufacture of the aqueous composition, it is essential that, in each area of the flowing aqueous solution used as raw material, the pH of the composition is kept in the same range as the pH is in the paper or board manufacture at the moment of draining the paper or board pulp. In this way, the pH variations in the pulp are avoided when the composition is added to the pulp. In the paper or board manufacturing process, large pH variations easily result in the generation of precipitates and problems with runnability. In mechanical pulp, an alkaline pH range causes darkening of the pulp. This can be observed, for example when treating wire water that contains fines.

Said or corresponding composition is preferably manufactured by adding oxide or hydroxide slurry, most suitably in the form of calcium oxide or calcium hydroxide slurry and, simultaneously, carbon dioxide to the flowing aqueous solution, so that the pH of the solution remains at a value of 6.0-8.3. The oxide or hydroxide is added in an amount that yields a concentration of at least 0.01%, e.g. about 0.01-5%, preferably about 0.01-3%, calculated from the weight of the solid matter of the final pulp.

This composition provides a paper or board product that contains at least said aqueous composition and fibre.

One of the most important buffer systems of the pH of water is related to the chemistry of carbonate ions. This is especially important in paper and board machines, where the intention is normally to keep the pH of the white water system within a pseudo neutral or neutral range. The pH range of 6-8 is normal for modern paper and cardboard machines. The greatest reasons for selecting this pH range are the use of coating pigments that come along with carbonate fillers and coated refuse, and often the faster dewatering process that is achieved in this pH range. The carbonate system refers to the change of different carbonate states according to the pH. The main states of carbonate are:

$$H_2CO_3 \leftrightarrow HCO_3^- \leftrightarrow CO_3^{2-}$$

At an acidic pH, soluble carbon dioxide ($CO_2$) and, to a minor degree, carbonic acid ($H_2CO_3$), are the main states of carbonate. In the neutral (on both sides of pH 7) and alkaline ranges, bicarbonate, i.e. hydrogen carbonate ($HCO_3^-$) is the main state of carbonate up to a pH of about 10. In a highly alkaline range (pH>10), carbonate ($CO_3^{2-}$) is the main state. When moving from the alkaline range toward the acidic one, essentially all of the $CO_3^{2-}$ has been changed into the form of $HCO_3^-$ at a pH of about 8.3. In the most important pH range of the paper and board manufacture, pH 6-8, bicarbonate ($HCO_3^-$) is thus the prevailing state.

The calcium carbonate fillers and pigments consist of the calcium salts of carbonic acid, which in the paper and board industry are generally known as ground calcium carbonate (GCC) or precipitated calcium carbonates (PCC). Conventionally, the aim has been to keep the average particle size of these larger than 500 nanometers, typically at 1-2 micrometers, as it is believed that the best possible light scattering results (brightness and opacity) are then achieved. Their solubility in water is fairly small under normal conditions. One purpose of the use of calcium carbonate fillers and pigments is to replace the often more expensive fibre in the finished paper or board. Under acidic conditions, however, soluble calcium ions are released from calcium carbonate, increasing the hardness of water. Decreasing the pH from 8 to 7 can increase the number of dissolved $Ca^{2+}$ ions up to hundredfold. Typically, the pH of carbonate slurries is kept at about pH 8, if not higher, to avoid the dissolution of fillers and pigments that is adverse to the structure. When the significance of bicarbonate ($HCO_3^-$) and of the colloidal calcium carbonate particles is reduced, the greatest positive advantages of this invention in the paper and board manufacture are also lost.

In the present invention, it has been observed that if there is dissolved carbon dioxide present in the water, the calcium carbonate will dissolve and change its state into calcium bicarbonate. It has thus been discovered to be beneficial to treat the process waters of the paper or board machine either with burnt calcium oxide (CaO) or calcium hydroxide ($Ca(OH)_2$) and to add carbon dioxide ($CO_2$) to the process waters, whereby advantages are achieved in the technical properties of paper, such as opacity, strength, stiffness, thickness (bulkiness), and printability.

It is essential that, when adding oxide or hydroxide, such as calcium oxide or calcium hydroxide or a mixture thereof to the process water, almost fibreless water is used. The headbox pulp or so-called high consistency pulp is thus not used for this purpose. These oxides or hydroxides or their mixtures are added simultaneously with carbon dioxide in amounts that keep the pH of the final aqueous composition within the same range as it is at the drainage stage of the paper or cardboard pulp. In this way, the pH range of 6.0-8.3 is maintained. Thus, an aqueous solution of a colloidal-size carbonate compound (with an average particle size of less than 300 nm, preferably less than 100 nm) and a bicarbonate compound can be formed, and the effect of the carbonate ($CO_3^{2-}$) ion is minimized.

The process water to be treated is preferably raw water, chemically purified water, mechanically purified water, wire water, filtrate water purified to different degrees of purity, or another type of water that is used at the paper or board factory, or a mixture of two or more of the above.

According to the above, variations in the pH cause among others precipitation, for example when $CaCO_3$ particles precipitate from $Ca(HCO_3)_2$, which particles can be of the size of elementary particles (smaller than 10 nanometers). By minimizing the pH variations at the manufacturing stage of the aqueous composition according to the invention, the generation of possible adverse precipitates and runnability problems are prevented, and the decrease in brightness typical of mechanical pulp in the alkaline pH range is reduced. Generally, the runnability problems in the paper or board machine appear as contamination, breaks, of for example wires and felts.

In the method of the present invention for manufacturing paper or board, and particularly in the manufacture of the aqueous composition used therein, it is essential that the burnt lime or calciumhydroxide is added to the aqueous solution, such as the process water of the papermanufacture, simultaneously with the carbon dioxide, whereby the pH of the process water remains on its original level during the addition of all these components.

When treating the process waters of paper or board machines in the plant, a larger amount of useful bicarbonate is obtained per unit volume of the aqueous solution than if calcium carbonate slurries were treated. The calcium carbonate used in the invention should, however, have a colloidal average particle size of preferably below 100 nanometers.

As a result of the carbon dioxide hydrating in water, the bicarbonate reacts with the fibre and the charged groups of the fines, for example carboxyl and hydroxyl groups, as well as possibly influences the formation of hydrogen bonds between these groups and water molecules. The different states of the carbonate ions present in the solutions of the invention influence so as to reduce the thickness of the so-called repulsion zone on the surfaces of the various solid matters of the paper or board pulp. Thus, it is also easier for the different surface reactions, such as flocculation and coagulation, to take place.

In the present invention, it is demonstrated that when the above mentioned "acidic water", i.e. the aqueous composition, is used as such in diluting the paper or board pulp and particularly by further adding charged polymer to this diluted paper or board pulp, the numerous technical properties of paper can be positively influenced, particularly the dewatering, retention, formation, strength, opacity, printability (the absorption properties of printing ink), thickness, i.e. bulkiness, and stiffness.

The following examples describe the specific preferred embodiments of the present invention. They are intended to illustrate the advantages and benefits achievable by the invention, and not to limit the scope of the invention.

EXAMPLES

The results below refer to the fact that the smallest calcium carbonate particles, the so-called elementary particles (smaller than 10 nanometers), attach themselves to the surface of the fibre, strengthening the structure. At the same time, the bicarbonate acts on the charge of the fibrils of the fibre by pushing the fibrils away from the fibre surface and each other. When their surface area is increased, the outward-oriented fibrils hydrate more easily under the effect of water. Colloidal calcium carbonate particles are adsorbed into the fibrils, particularly with cationic polymers. Thus, the hydrated and carbonated fibrils of the fibres intertwine, whereby a strong structure is created. The calcium carbonate particles of both elementary particle size and colloidal size fit between the fibrils and fibre, thus keeping the fibrils in their outward-oriented positions and giving stiffness and thickness (bulkiness) to the structure of the paper or board. A portion of the carbonate particles agglomerate with each other, which improves the opacity and printability when porosity is formed between the particles, which, in turn, improves light scattering and the absorption of printing ink. The intertwined, outward-oriented fibrils together with the colloidal calcium carbonates form a reinforced structure, which can be observed as better strength properties with the same filler content. Due to the smaller amount of fibrils in mechanical pulps, the fines function so as to strengthen the structure of the fibre network similarly to the fibrils.

Example 1 is a comparative test which demonstrates that the addition of colloidal calcium carbonate, according to WO 2005/100690 A1, does not provide the same dewatering efficiency as the product according to the invention. The main differences are that, when treating the process waters of the paper or board machine according to the present invention, particularly bicarbonate (possibly also soluble carbon dioxide and carbonic acid) is provided in the water in addition to the colloidal calcium carbonate particles. Furthermore, a considerably larger amount of the states of carbonate other than calcium carbonate is obtained in the same volume, when the process water is treated than when colloidal calcium carbonate is added to the process waters in the form of slurry or in a dry form. In the reference, no advantages were achieved other than bringing the dewatering to the same level as when using the same amount of colloidal silicon dioxide.

Example 1

Comparison Between Commercial Colloidal Calcium Carbonate and the Acidic Water According to the Invention A Valley grinder was used to first grind a mixture of bleached pine pulp and bleached birch pulp to an SR number of 25.30% of pine pulp was used of the weight of wood pulp and 70% of birch pulp. This pulp was diluted with ion-exchanged water or the acidic water (AW) according to the invention, to a consistency of 0.7% before the dewatering tests. The conductivity of the ion-exchanged water was adjusted to 1.2 mS/cm with NaCl salt. In addition, its pH was adjusted to 7.2 with 5% sulphuric acid before the dilution.

The acidic water (AW) was prepared in ion-exchanged water. First, 25 kg of ion-exchanged water was weighed into a closable plastic can (30 liters volume). 167 grammes of burnt lime (CaO) were added to 350 grammes of ion-exchanged water at 45° C., while mixing gently. The slaked lime thus generated was added simultaneously with carbon dioxide to 25 kilos of ion-exchanged water, while keeping the pH at 7.2. This solution was allowed to sediment for 12 hours, after which the colloidal portion that had not sedimented was separated from the can. The precipitate that had sedimented on the bottom was not used in the tests. The average particle size of this colloidal substance was 52 nanometers (Malvern nano-ZS) and its dry matter content was 0.14 g/l.

In the tests, the AW product, which had already been added along with the dilution water of the pulp, was compared to a Socal 31 (Solvay) product. Socal 31 is a colloidal calcium carbonate, the average particle size of which is 70 nanometers, according to the manufacturer. This is also the product that is mentioned in WO 2005/100690 A1.

Thereafter, 1000 ml of the above pulps were mixed with cationic starch (Basf, Raisamyl 70021) in a DDJ (Britt jar) mixer for 60 seconds at a velocity of 500 rotations per minute. The starch was added after a mixing of 10 seconds and Socal 31 after a mixing of 20 seconds (however, not at the AW1 and AW2 points, where the ion-exchanged water had already been converted into acidic water). After this, a dewatering test was conducted on the treated pulp by an SR (Schopper Riegler) device, using the standard metal wire of the device in the filtration. The time consumed in the draining of 500 ml was written down. The various test points and results are shown in the table below (Table 1). The chemical dosages are calculated from dry fibre.

TABLE 1

| Test point | Blank test | Starch | Soc1 | Soc2 | Soc3 | AW1 | Soc4 | Soc5 | Soc6 | AW2 |
|---|---|---|---|---|---|---|---|---|---|---|
| Starch, % | 0 | 1.5 | 0 | 0 | 0 | 0 | 1.5 | 1.5 | 1.5 | 1.5 |
| $CaCO_3$, % | 0 | 0 | 0.15 | 2.0 | 15.2 | 2.0 | 15.2 | 2.0 | 0.15 | 2.0 |
| Drainage time, s | 130 | 146 | 132 | 144 | 176 | 117 | 122 | 116 | 104 | 82 |

Already at the AW1 test point, it becomes clear that the acidic water improves the dewatering properties without cationic starch. The Socal product (SOC1, SOC2, and SOC3) does not exhibit this effect. The same is also evident from WO 2005/100690 A1, where the Socal product alone weakened the dewatering. The results show that the product of the present invention functions better and more effectively than the colloidal calcium carbonate as such.

Example 2

Dewatering and Filler Retention Tests on the Acidic Water According to the Invention The SR (Schopper Riegler) device was used to test the dewatering properties of uncoated fine paper pulp by using the standard metal wire of the device in the filtering. The time consumed in the infiltration of 550 ml of a sample of 1000 ml was written down in the dewatering test. The retention agents used were cationic polyacrylamide (Praestratet PK 435; below, PAM) and anionic microparticle (Perform SP7200; below, SP). The headbox pulp was taken after the feed pump of the headbox of an uncoated fine paper machine, before dosing the polymeric retention agents. The paper machine uses ground calcium carbonate (Hydrocarb 60, Omya) as filler, and the pulp contained 24% of ashes (at 575° C. for two hours). The consistency of the headbox pulp was 0.6%. The filler retention tests were conducted by the DDJ (Britt Jar) mixer using the wire of the paper machine in question in the retention tests.

The acidic water (below, AW) was prepared so that 60 g of burnt lime (CaO) were mixed with 250 g of tap water at 45° C. The headbox pulp was allowed to sediment for 12 hours, after which the colloidal portion that had not sedimented was separated. The pulp that had sedimented on the bottom was used later in the tests. After this, the water of the separated headbox pulp and the calcium hydroxide prepared above were allowed to react with the carbon dioxide that was conducted thereto, so that the pH was at 7.2 during the preparation. After 12 hours of sedimentation, the precipitate that had sedimented on the bottom was separated from the colloidal substance. The average particle size of the colloidal substance generated therefrom (mainly calcium carbonate and bicarbonate) was 44 nanometers (Malvern nano-ZS). The precipitate that had sedimented on the bottom was not used in the tests. The headbox pulp that had sedimented on the bottom earlier was diluted back to a consistency of 0.6% by the acidic water thus prepared.

Table 2 shows the dilution water of the headbox either as AW or normal water. Normal refers to the untreated, original sedimented dilution water of the headbox pulp. At the control test points (marked with control 1 or 2), 1000 milliliters of treated (AW) or original headbox pulp were first added to the DDJ mixer. After five seconds of mixing (at a velocity of 1000 rotations per minute), 400 g/t of PAM was added to the mixer. After ten seconds, the velocity of the mixer was raised to 1500 rotations per minute for 30 seconds. After this, the velocity was again reduced to 1000 rotations, and 300 g/t of microparticles (SP) were added into the DDJ. After 55 seconds from starting the mixing, a filler retention test was conducted by the DDJ or a dewatering test by the SR device. In the filler retention test, 200 milliliters of filtrate were recovered, from which the dry matter concentration was defined. Later on, the filler concentration of the filtrate was defined by burning the filtrate at 575° C. for two hours. At other test points, 400 g/t of PAM was used, so that 400 g/t of PAM was added to the treated (AW) or untreated headbox pulp and was allowed to mix for 10 seconds at a velocity of 1000 rotations, before conducting the filler retention or dewatering tests. Six parallel tests were conducted for both the retention and dewatering tests at all the test points.

PAM pre means that PAM was added before raising to the velocity of 1500 rotations, 5 seconds from starting the mixing, to the velocity of 1000 rotations. PAM post means that no raising of velocity was used here, but PAM was mixed in the DDJ for 10 seconds at the velocity of 1000 rotations per minute before the retention and dewatering tests. SP post means that the microparticle (SP) was added after the stage of the higher mixing velocity (1500 rotations per minute, 30 seconds), 40 seconds from starting the mixing, as described in the description of the control test points above.

TABLE 2

Test points

| Test point | PAM pre, P g/t | SP post, g/t | PAM post, g/t | Dilution water |
|---|---|---|---|---|
| Blank test 1 | 0 | 0 | 0 | Normal |
| Blank test 2 | 0 | 0 | 0 | AW |
| Control 1 | 400 | 300 | 0 | Normal |
| Control 2 | 400 | 300 | 0 | AW |
| PAM 1 | 0 | 0 | 400 | Normal |
| PAM 2 | 0 | 0 | 400 | AW |

Table 3 shows the dewatering and filler retention results of the above test points.

TABLE 3

Results of the dewatering and retention tests

| Test point | Dewatering, s | Filler retention, % |
|---|---|---|
| Blank test 1 | 85 | 5.6 |
| Blank test 2 | 66 | 18.1 |
| Control 1 | 32 | 72.4 |

TABLE 3-continued

Results of the dewatering and retention tests

| Test point | Dewatering, s | Filler retention, % |
|---|---|---|
| Control 2 | 17 | 81.3 |
| PAM 1 | 47 | 50.2 |
| PAM 2 | 14 | 85.6 |

The results clearly indicate that the colloidal calcium carbonate together with the bicarbonate and the other carbonate states considerably improves the dewatering and retention. It is interesting that the best dewatering and filler retention readings are achieved by adding, as the retention polymer, only polyacrylamide, which simplifies the chemical system.

Example 3

Sheet Test Series and Description of Some Achieved Properties Determined from the Paper In this test series, the Valley grinder was used to first grind a mixture of bleached pine pulp and bleached birch pulp to an SR number of 25.30% pine pulp of the weight of wood pulp was used and 70% of birch pulp. In addition, 10% of precipitated calcium carbonate (FS-240, Shaefer Finland Oy) calculated from dry fibre was mixed with this pulp. This pulp was diluted with ion-exchanged water or the acidic water (AW) according to the invention to a consistency of 0.2% before making the sheets.

In the tests, two different acidic waters were used, differing from each other according to the added amount of burnt lime (CaO). The acidic water (AW) was prepared in ion-exchanged water. 25 kg of ion-exchanged water was first weighed into each one of two closable plastic cans (30 liters volume). Either 83 or 167 g of burnt lime (CaO) was first slaked in 350 g of ion-exchanged water at 45° C. These test points are below called AW1 (83 g) and AW2 (167 g). Carbon dioxide was added simultaneously with either the burnt lime AW1 or AW2 into the above-mentioned quantities of 25 kg of ion-exchanged water, separately, so that the pH was kept at 7.2. This solution was allowed to sediment for 12 hours, after which the colloidal portion that had not sedimented was separated from the can. The precipitate that sedimented on the bottom was not used in the tests. The average particle size of this separated, colloidal substance was 56 (AW1) and 63 nanometers (AW2) (Malvern nano-ZS) and its dry matter content was 0.10 (AW1) and 0.13 g/l (AW2). These waters were used as such as dilution water to dilute the ground chemical pulp to a consistency of 0.2%.

As a reference test point, scalenohedric precipitated calcium carbonate (S—PCC) was added to the ground fine paper pulp in three different added amounts—0, 20% and 40% calculated from dry fibre. The used scalenohedric PCC was Precarb FS-240 (Shaefer Finland Oy). After this, the pulps were diluted to a consistency of 0.2%, similarly to the AW test points.

From the thus prepared pulps with consistencies of 0.2%, sheets of 50 g/m$^2$ were prepared in a sheet mould without circulation water, according to the standards SCAN-C 26:76 (SCAN-M 5:76). 15 sheets were prepared from each test point using cationic polyacrylamide (Praestaret PK 435) as retention agents. After this, the sheets were dried in a drum drier at 120° C. for two hours, before the sheets were taken to mellow to 23° C. and a relative humidity of 50% for 48 hours. After this, the basis weights of the sheets were checked and these properties were determined:

Filler content (575° C. and 2 hours)

ISO brightness (L&W Elrepho Spectrophotometer SE070), ISO 2470

Opacity (L&W Elrepho Spectrophotometer SE070), ISO 2471

Scott bond (Internal bond tester Huygen), Tappi-UM403

Stiffness (L&W paper bending tester SE160), ISO 2493/SCAN-P 29:95

Thickness (L&W Thickness tester SE51), ISO 534

The basis weights of the sheets were at the target basis weight of 50 g/m$^2$, with an accuracy of ±0.3 g/m$^2$.

The assessment of the printing properties of the sheets in this test was made by measuring the density. The sheets were printed in a Universal Testprinter (Testprint B.V.) using a Cold set black (Sun Chemical, viscosity 7.3 Pas) with 10 milligrammes of ink on the upper surface of the sheet. The densities were measured using a densitometer (Macbeth) from aerated and dried samples after 24 hours from the printing. The Universal testprinter employed a pressure of 630 N and a velocity of 1 m/s.

According to the filler content determined from the sheets (575° C. and 2 hours), the results are normalized to the same filler content (in this case, to 10.3 and 10.7%) in Table 4. The results that were linearly normalized to the filler contents of 10.3% and 10.7% (the 10.3% control and 10.7% control) correspond to the filler contents in test points AW1 and AW2. A reliability of 95% means a confidence interval of 95%. At AW1 the filler content was 10.3%, and at AW2 the filler content was 10.7%.

TABLE 4

Results from the sheet tests

| Test point | ISO brightness, % | Opacity, % | Scott Bond, J/m2 | Stiffness, μNm | Density, 10 g | Thickness, μm |
|---|---|---|---|---|---|---|
| AW1 (10.3%) | 89.2 | 83.2 | 287 | 115 | 1.58 | 110 |
| 10.3% control | 89.1 | 82.3 | 259 | 89 | 1.35 | 107 |
| AW2 (10.7%) | 89.1 | 84.5 | 265 | 150 | 1.53 | 118 |
| 10.7% control | 89.2 | 82.4 | 256 | 89 | 1.35 | 107 |
| Reliability of 95% | ±0.18 | ±0.4 | ±3.6 | ±14 | ±0.05 | ±1.41 |

The brightness remains on the same level, but the opacity, stiffness, thickness, and the setting of printing ink can clearly be improved. Furthermore, a stronger sheet is also achieved with the same filler content. When measured from the handsheets, the Scott bond describes the strength the best, since no fibre orientation is obtained for the fibres in the hand mould. The higher density values mean that the printing ink has set on the surface and not penetrated through the sheet, which would be visible among others in print through measurements. An increase in thickness means that the bulkiness of the paper or board is increased. It is obvious that the colloidal calcium carbonate, bicarbonate, and other states of carbonate influence so as to strengthen the sheet structure, and at the same time, considerably improve the non-transparency, i.e. opacity, and the setting of printing ink.

Example 4

Dewatering Test on Acidic Waters of the Invention Prepared in Different Ways In this test, headbox pulp at a consistency of 0.3% was taken from the middle layer of a folding board machine before dosing the retention agents. The pulp consisted of pressure groundwood (PWG). The test compared the dewatering properties using acidic water, wherein the pH was first allowed to increase and then to decrease to where the pH was kept standard when adding the calcium hydroxide. The pH of the wire water was 7.0.

Calcium hydroxide slurry was prepared for the test points, where the pH varies (below: V1 and V2), so that either 60 g (V1) or 100 g (V2) of burnt lime (CaO) was mixed with 400 g of tap water at 45° C. In the same way, calcium hydroxide slurries were prepared for the test points, where the pH was kept at 7.0 (below: V3 and V4). In V3, a calcium oxide amount of 60 g was used, and in V4 a calcium oxide amount of 100 g. Four headbox pulps of 30 kg were allowed to sediment for 12 hours in plastic cans, after which the colloidal portion that had not sedimented was separated. The pulp that sedimented on the bottom was used later in the tests. After this, the water of the separated headbox pulp and the calcium hydroxide prepared above were allowed to react with the carbon dioxide conducted thereto, so that the pH was at 7.0 during the preparation (test points V3 and V4). In test points V1 and V2, the calcium hydroxide slurries were added directly to the separated water of the headbox pulp, whereby the pH first rose to about 12. After this, the pH was lowered back to 7.0 using carbon dioxide. After 12 hours of sedimentation, the precipitate that had sedimented on the bottom was separated from the colloidal substance. This precipitate that had sedimented on the bottom was not used in the tests. The acidic waters thus prepared were used to dilute the headbox pulps that had earlier sedimented on the bottom, back to a consistency of 0.3%.

1000 milliliters of acidic water pulps (V1, V2, V3, and V4), prepared as above, and of the original untreated pulp (the blank test) were taken to the DDJ mixer. After five seconds of mixing (at a velocity of 1000 rotations per minute) PAM (Praestaret PK 435) was added to the mixer at 400 g/t and mixes for 10 seconds, before conducting the dewatering test using the SR device (Schopper Riegler) by using the standard metal wire of the device in filtering. The time consumed for the filtering of 500 milliliters was written down.

TABLE 5

Results of dewatering

| Test point | Dewatering, s |
|---|---|
| Blank test | 220 |
| V1 | 28 |
| V2 | 20 |
| V3 | 19 |
| V4 | 16 |

Table 5 shows that minimizing the pH variations improves the dewatering results (test points V3 and V4).

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method of manufacturing paper or cardboard, which comprises: a) diluting paper or board pulp with an aqueous composition, and b) removing water from the pulp by draining, pressing, and drying, wherein the aqueous composition is prepared by: i) adding calcium oxide or calcium hydroxide slurry to flowing and almost fibreless process water or a mixture of almost fibreless process water and pure water in a content that is at least 0.01% calculated from the weight of the solid matter of the paper or board pulp to form a mixture, ii) simultaneously adding carbon dioxide to the flowing and almost fibreless process water or mixture of almost fibreless process water and pure water, so that the pH of the mixture remains at 6.0-8.3, whereby a colloidal portion and a sediment are formed, and iii) separating the colloidal portion from the sediment to yield the aqueous composition.

2. The method according to claim 1, wherein the paper or board pulp is first diluted with the aqueous composition, whereafter one or more charged polymers are added and the one or more charged polymers are reacted with the diluted paper or board pulp before water is removed from the pulp.

3. The method according to claim 1, wherein one or more charged polymers or a mixture thereof is dosed into the paper pulp at a stage of the paper or board manufacturing process that follows the dilution with the aqueous composition.

4. The method according to claim 3, wherein the charged polymer is a natural polymer, synthetic polymer, copolymer or a mixture of the above.

5. The method according to claim 3, wherein the charged polymer is cationic polyacrylamide, polyethyleneimine, starch, polydadmac, polyacrylamide, polyamine, starch-based coagulant, a copolymer of any of the above or a mixture of any of these.

6. The method according to claim 5, wherein the charged polymer is polydadmac, polyamine, polyacrylamide or a copolymer of two or more of these.

7. The method according to claim 3, wherein up to 10% of the charged polymer is dosed, calculated from the weight of the solid matter of the pulp.

8. The method according to claim 1, wherein microparticles are added to the pulp.

9. The method according to claim 8, wherein the microparticles are sols, gels, microgels, silicic acids, polysilicic acids containing bentonites or silicon dioxide, or a mixture of any of the above.

10. The method according to claim 8, wherein up to 10% of microparticles is dosed into the pulp, calculated from the weight of the solid matter of the pulp.

11. The method according to claim 1, wherein a compound containing water-soluble aluminium is added to the pulp.

12. The method according to claim 11, wherein up to 10% of the aluminium-containing compound is dosed into the pulp, calculated from the weight of the solid matter of the pulp.

13. The method according to claim 1, wherein the process water is raw water, chemically purified water, mechanically purified water, wire water, filtered water, or a mixture of two or more of the above.

14. The method according to claim 3 wherein the charged polymer is a polyacrylamide.

15. The method according to claim 1 wherein the pulp drains more rapidly than in a method wherein the aqueous composition is replaced with an aqueous suspension of ground calcium carbonate.

* * * * *